US008519367B2

(12) United States Patent
Metzmacher et al.

(10) Patent No.: US 8,519,367 B2
(45) Date of Patent: Aug. 27, 2013

(54) EXTREME UV RADIATION GENERATING DEVICE COMPRISING A CORROSION-RESISTANT MATERIAL

(75) Inventors: Christof Metzmacher, La Calamine (BE); Achim Weber, Aachen (DE)

(73) Assignees: Koninklijke Philips N.V., Eindhoven (NL); Xtreme Technologies GmbH, Aachen (DE)

( * ) Notice: Subject to any disclaimer, the term of this patent is extended or adjusted under 35 U.S.C. 154(b) by 312 days.

(21) Appl. No.: 13/000,733

(22) PCT Filed: Jul. 1, 2009

(86) PCT No.: PCT/IB2009/052853

§ 371 (c)(1), (2), (4) Date: Dec. 22, 2010

(87) PCT Pub. No.: WO2010/004481

PCT Pub. Date: Jan. 14, 2010

(65) Prior Publication Data

US 2011/0101251 A1 May 5, 2011

(30) Foreign Application Priority Data

Jul. 7, 2008 (EP) ..... 08104652

(51) Int. Cl.
*H01J 35/20* (2006.01)

(52) U.S. Cl.
CPC ..... *H01J 35/20* (2013.01)
USPC ..... 250/504 R

(58) Field of Classification Search
USPC ..... 250/504 R, 503.1; 378/119, 143
See application file for complete search history.

(56) References Cited

U.S. PATENT DOCUMENTS

| | | | | |
|---|---|---|---|---|
| 7,378,673 | B2 * | 5/2008 | Bykanov et al. | 250/503.1 |
| 7,763,872 | B2 * | 7/2010 | O'Reilly et al. | 250/504 R |
| 7,872,245 | B2 * | 1/2011 | Vaschenko et al. | 250/492.2 |
| 2005/0244572 | A1 | 11/2005 | Bristol et al. | |
| 2006/0192155 | A1 | 8/2006 | Algots et al. | |
| 2007/0018119 | A1 | 1/2007 | Yabuta et al. | |
| 2007/0152175 | A1 | 7/2007 | Moors et al. | |
| 2007/0230531 | A1 | 10/2007 | Hergenhan et al. | |
| 2010/0200776 | A1 * | 8/2010 | Yabu et al. | 250/504 R |

FOREIGN PATENT DOCUMENTS

| | | | |
|---|---|---|---|
| WO | 2005025280 | A2 | 3/2005 |
| WO | 2006093782 | A2 | 9/2006 |

* cited by examiner

*Primary Examiner* — Kiet T Nguyen

(57) ABSTRACT

The invention relates to an improved EUV generating device having coated supply pipes for the liquid tin, in order to provide an extreme UV radiation generating device which is capable of providing a less contaminated flow of tin to and from a plasma generating part.

8 Claims, 3 Drawing Sheets

EXTREME UV RADIATION GENERATING DEVICE COMPRISING A CORROSION-RESISTANT MATERIAL

FIELD OF THE INVENTION

The invention relates to extreme UV radiation generating devices, especially EUV radiation generating devices which make use of the excitation of a tin-based plasma.

BACKGROUND OF THE INVENTION

This invention relates to extreme UV radiation generating devices. These devices are believed to play a great role for the upcoming "next generation" lithography tools of the semiconductor industry.

It is known in the art to generate EUV light e.g. by the excitation of a plasma of an EUV source material which plasma may be created by a means of a laser beam irradiating the target material at a plasma initiation site (i.e., Laser Produced Plasma, 'LPP') or may be created by a discharge between electrodes forming a plasma, e.g., at a plasma focus or plasma pinch site (i.e., Discharge Produced Plasma 'DPP') and with a target material delivered to such a site at the time of the discharge.

However, in both techniques a flow of liquid tin, which is supposed to be one of the potential target materials, is required, i.e. that certain parts of the EUV generating device are constantly exposed to relatively harsh chemical and physical conditions at elevated temperatures of greater than e.g. 200° C.

To further complicate the situation there is also the prerequisite that the tin needs to be free from contamination in order to secure a high quality of a pure tin plasma.

SUMMARY OF THE INVENTION

It is an object of the present invention to provide an extreme UV radiation generating device which is capable of providing a less contaminated flow of tin to and from the plasma generating part of said device.

This object is solved by an extreme UV radiation generating device of the present invention. As illustrated in FIG. 4 an extreme UV radiation generating device 40 is provided, comprising a plasma generator or generating device 42, at least one tin supply system having a supply reservoir 44 in fluid connection with said plasma generator or generating device 42 adapted to supply said plasma generator or generating device 42 with liquid tin, whereby said tin supply system comprises at least one supply pipe means 46 for the supply of tin, whereby said supply pipe or means 46 is at least partly coated with at least one covalent inorganic solid material 48.

The term "plasma generating device" in the sense of the present invention means and/or includes especially any device which is capable of generating and/or exciting a tin-based plasma in order to generate extreme UV light. It should be noted that the plasma generating device of this invention can be any device known in the field to the skilled person.

The term "tin supply system" in the sense of the present invention means and/or includes especially any system capable of generating, containing and/or transporting liquid tin such as e.g. heating vessels, delivery systems and tubings.

The term "supply means" in the sense of the present invention means and/or includes especially at least one vessel and/or at least one reservoir and/or at least one tubing capable of generating, containing and/or transporting liquid tin.

The term "coated" in the sense of the present invention means and/or includes that the part of the supply means which is in direct exposure to the liquid tin when the EUV device is in operation comprises at least partly a material as described in the present invention. The term "coated" is not intended to limit the invention to said embodiments, where a material has been deposited on the supply means (although this is one embodiment of the present invention). It comprises as well embodiments, where the supply means has been treated in order to achieve said coating.

Furthermore the term "coated" is not intended to limit the invention to embodiments, where the supply material is made essentially of one material with only a small "coating" out of the material(s) as described in the present invention. In this invention also embodiments where the supply material essentially comprises a uniform material are meant to be included as well.

The term "covalent inorganic solid material" especially means and/or includes a solid material whose elementary constituents have a value in the difference of electronegativity of $\leqq 2$ (Allred & Rochow), preferably in such a way that the polar or ionic character of the bonding between the elementary constituents is small.

The use of such an extreme UV radiation generating device has shown for a wide range of applications within the present invention to have at least one of the following advantages:

- Due to the coating of the supply means the contamination of tin may be greatly reduced, thus increasing both the lifetime and the quality of the EUV device
- Due to the coating of the supply means the contamination of tin may be greatly reduced, thus increasing the purity ("cleanliness" of the radiation) of the EUV emission itself
- Due to the coating of the supply means the contamination of tin may be greatly reduced, thus maintaining the high quality and purity of the liquid tin itself over a prolonged time, thus avoiding a regular change of the tin itself
- Due to the coating of the supply means the fabrication of the supply means itself becomes cheaper and handling becomes easier (e.g. with respect to mechanics) as the base material can be applied and be coated ready in shape just prior to be used in the EUV device
- Due to the coating of the supply means the supply means itself is insulating, thus being protected against electrical and thermal currents According to a preferred embodiment of the present invention, at least one covalent inorganic solid material comprises a solid material selected from the group of oxides, nitrides, borides, phosphides, carbides, sulfides, silicides and/or mixtures thereof.

These materials have proven themselves in practice especially due to their good anti-corrosive properties.

According to a preferred embodiment of the present invention, the covalent inorganic solid material comprises at least one material which has a melting point of $\geqq 1000°$ C.

By doing so especially the long-time performance of the EUV-generating device can be improved.

Preferably the covalent inorganic solid material has a melting point of $\geqq 1000°$ C., more preferred $\geqq 1500°$ C. and most preferred $\geqq 2000°$ C.

According to a preferred embodiment of the present invention, the covalent inorganic solid material comprises at least one material which has a density of $\geqq 2$ g/cm$^3$ and $\leqq 8$ g/cm$^3$.

By doing so especially the long-time performance of the EUV-generating device can be improved.

Preferably the covalent inorganic solid material comprises at least one material with a density of ≧2.3 g/cm$^3$, more preferred ≧4.5 g/cm$^3$ and most preferred ≧7 g/cm$^3$.

According to a preferred embodiment of the present invention, the covalent inorganic solid material comprises at least one material whose atomic structure is based on close packing of at least one of the atomic constituents of ≧60%. Package density is defined as the numbers of atomic constituents per unit cell times the volume of a single atomic constituent divided by the geometric volume of the unit cell.

By doing so especially the long-time performance of the EUV-generating device can be improved.

Preferably the covalent inorganic solid material comprises at least one material with a package density of ≧65%, more preferred ≧68% and most preferred ≧70%.

According to a preferred embodiment of the present invention, the covalent inorganic solid material comprises of material which does not show a thermodynamic phase field of atomic constituents and tin in the target temperature range resulting from a chemical reaction between one of the atomic constituents and tin, i.e. the covalent inorganic solid material has a high chemical inertness against liquid tin.

By doing so especially the long-time performance of the EUV-generating device can be improved.

Preferably the covalent inorganic solid material comprises at least one material selected out of the group comprising oxides, nitrides, borides, phosphides, carbides, sulfides, and silicides of Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, La, Ce, Pr, Nd, Sm, Eu, Gd, Tb, Dy, Ho, Er, Tm, Yb, Lu, Hf, Ta, W, Re, Os, Ir, Pt, Au or mixtures thereof.

The covalent inorganic solid material can be synthesized by rather conventional production techniques, such as physical vapour deposition (PVD), e.g. evaporation, sputtering with and without magnetron and/or plasma assistance, or chemical vapour deposition (CVD), e.g. plasma-enhanced or low-pressure CVD, or molecular beam epitaxy (MBE), or pulsed laser deposition (PLD), or plasma spraying, or etching (chemical passivation), or thermal annealing (thermal passivation), or via melting (e.g. emaille), or galvanic or combinations thereof, e.g. thermo-chemical treatments.

According to a further aspect of the present invention illustrated in FIG. 4, an extreme UV radiation generating device 40 is provided, comprising a plasma generator or generating device 42, at least one tin supply system having a supply reservoir 44 in fluid connection with said plasma generator or generating device 42 adapted to supply said plasma generator or generating device 42 with liquid tin, whereby said tin supply system comprises at least one supply pipe or means 46 for the supply of tin, whereby said supply pipe or means 46 is at least partly coated with at least one metal 48 selected out of the group comprising IVb, Vb, VIb, and/or VIIIb metals or mixtures thereof.

The term "metal" in the sense of the present invention does not mean to be intended to limit the invention to embodiments, where said supply means is coated with a metal in pure form. Actually it is believed at least for a part of the metals according to the present invention that they may form a coating where there are constituents partly oxidized or otherwise reacted.

The use of such an extreme UV radiation generating device has shown for a wide range of applications within the present invention to have at least one of the following advantages:

- Due to the coating of the supply means the contamination of tin may be greatly reduced, thus increasing both the lifetime and the quality of the EUV-device
- Due to the coating of the supply means the contamination of tin may be greatly reduced, thus increasing the purity ("cleanliness" of the radiation) of the EUV emission itself
- Due to the coating of the supply means the contamination of tin may be greatly reduced, thus maintaining the high quality and purity of the liquid tin itself over a prolonged time, thus avoiding a regular change of the tin itself
- Due to the coating of the supply means the fabrication of the supply means itself becomes cheaper and handling becomes easier (e.g. with respect to mechanics) as the base material can be applied and be coated ready in shape just prior to be used in the EUV device
- Due to the coating of the supply means the supply means itself is insulating, thus being protected against electrical and thermal currents
- Due to the metallic coating of the supply means these devices are electrically and thermally conductive which might be an advantage in one or the other embodiment of the invention According to a preferred embodiment, the thickness of the metallic coating is ≧100 nm and ≦100 μm. This is usually a good compromise which has proven itself in practice.

According to a preferred embodiment, the roughness of the metallic coating is ≧1 nm and ≦1 μm. This has proven well in practice, too.

An extreme UV generating device according to the present invention may be of use in a broad variety of systems and/or applications, amongst them one or more of the following:

- semiconductor lithography
- metrology
- microscopy
- fission
- fusion
- soldering The aforementioned components, as well as the claimed components and the components to be used in accordance with the invention in the described embodiments, are not subject to any special exceptions with respect to their size, shape, compound selection and technical concept such that the selection criteria known in the pertinent field can be applied without limitations.

BRIEF DESCRIPTION OF THE DRAWINGS

Additional details, features, characteristics and advantages of the object of the invention are disclosed in the sub claims, the figures and the following description of the respective figures and examples, which—in an exemplary fashion—show several embodiments and examples of inventive compounds

In order to evaluate different materials and being able to judge to improve the quality of the material with respect to corrosion resistance against liquid tin, a material test stand was built. This device works in vacuum and allows test samples to be dipped into and slightly and slowly move in molten tin for a dedicated period of time.

Figure 1:
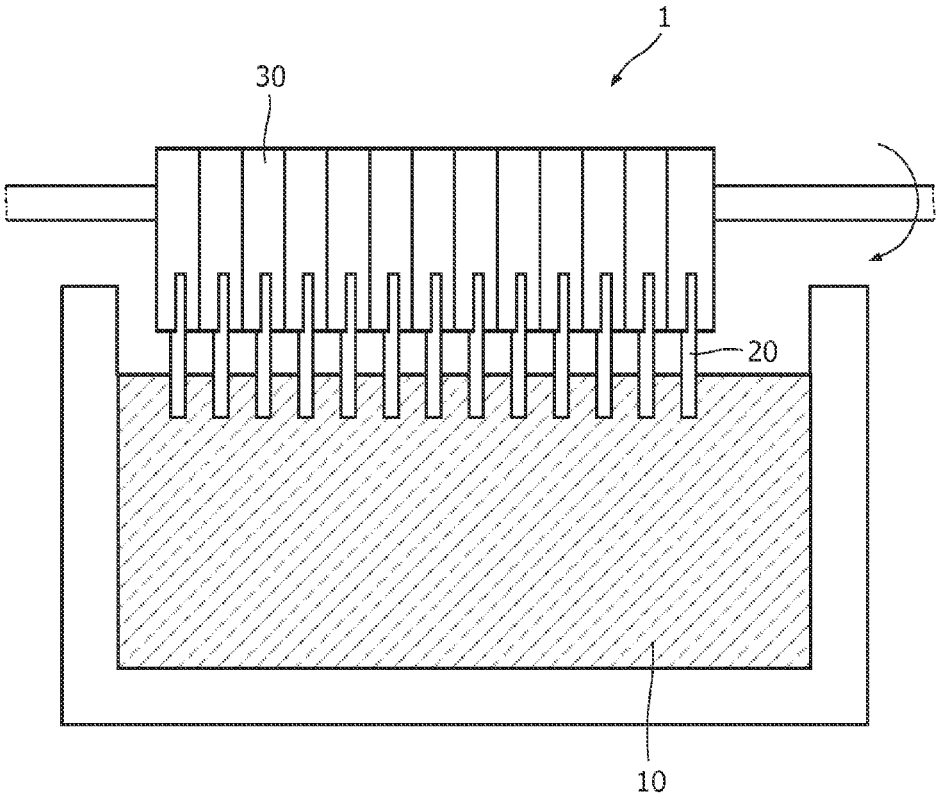
FIG. 1 shows a schematic figure of a material test stand which was used to evaluate the inventive (and comparative) examples of the present invention.
Figure 2:
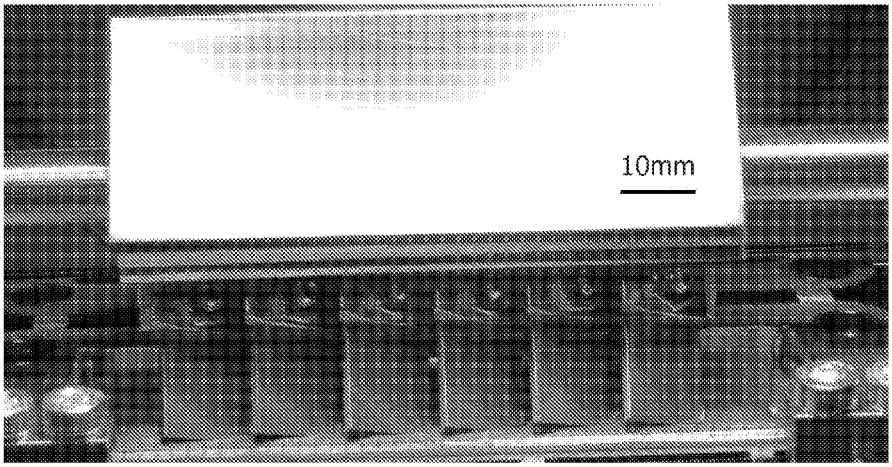
FIG. 2 shows a photograph of a test material prior to immersion.

The material test stand 1 is (very schematically) shown in FIG. 1 and comprises a tin bath 10, in which several test slides 20 which are mounted on a (turnable) holder 30 can be dipped at a controlled temperature. The dimension of the test slides will be approx. 30 mm×10 mm. FIG. 2 shows a photo of the test slides prior to immersion.

The temperature and atmosphere of the test stand is continuously logged and controlled.

The samples are investigated macroscopically in dedicated time lags in order to look for hints of failure, e.g., by dissolution of the test material, cracking, colouring, wetting etc. Moreover, the pure tin in the inert crucible (bath) applied prior to start of sample exposure, is inspected with respect to e.g. appearance of contamination or reaction products, too. During immersion it is possible to observe if and how the wetting behaviour of the material changes. After a dedicated time, e.g. 60 days, of continuous operation, the movement of the test samples is stopped and the test samples are extracted from immersion.

Either macroscopically visibly failed or nominally passed samples of all tested materials are investigated microscopically by light or scanning electron microscopy. By means of this a deeper insight into the nature of failure or non-failure mechanisms and at least an estimation of the so-called corrosion length are possible. Corrosion length is the extrapolated deepness of reaction or affected zone of a material due to the interaction with the liquid tin, related to a time scale, e.g. μm/year. In addition, conventional methods such as weighing or optical profilometry are probable as well. The microscopic investigation results in the conclusion if a tested material is capable of withstanding liquid tin at least for a dedicated time.

The results of the investigation of several inventive and comparative Examples are shown in Table I. The test was made at 300° C. for 60 days.

TABLE I

| Material | Inventive/ Comparative | Wetting (macrosc.) | Corrosion (microsc.) |
|---|---|---|---|
| Stainless steel | Comparative | Yes | Yes |
| Cast iron | Comparative | Yes | Yes |
| Co base alloys | Comparative | Yes | Yes |
| Cr | Comparative | Yes | Yes |
| Stainless steel, thermically treated to form a covalent oxide layer | Inventive | Yes | No |
| Graphite | Inventive | No | No |
| Mo | Inventive | No | No |
| Ti | Inventive | No | No |
| Co base alloys | Inventive | Yes | No |
| Cr | Inventive | No | No |
| AlN | Inventive | No | No |
| TiAlN | Inventive | No | No |
| TiN | Inventive | No | No |
| TiCN | Inventive | No | No |
| CrN | Inventive | No | No |
| DLC (diamond) | Inventive | No | No |
| α-Si | Inventive | No | No |
| SiO2 | Inventive | No | No |
| SiN*x* | Inventive | No | No |
| Emaille | Inventive | No | No |
| $ZrO_2$ | Inventive | No | No |
| FeB, Fe2B | Inventive | No | No |

All inventive compounds show no corrosion and only a few a wetting, even after 60 days, However, in the comparative examples, severe corrosion (sometimes even after a few days) can be seen.

Figure 3:
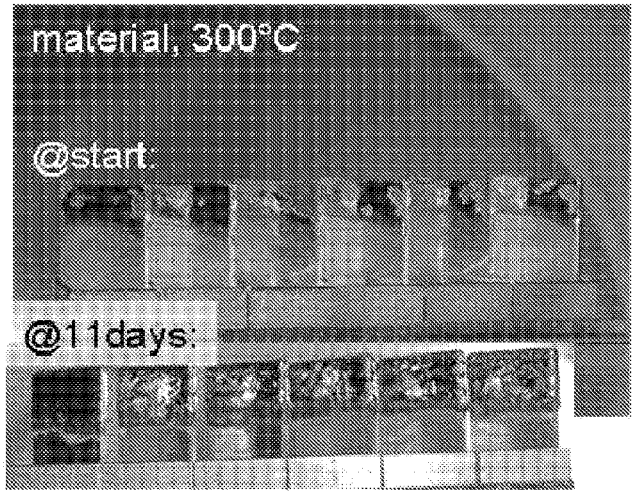
FIG. 3 shows a figure showing the corrosion of a material according to a comparative example after 11 days at 300° C. in the tin bath.
Figure 4:
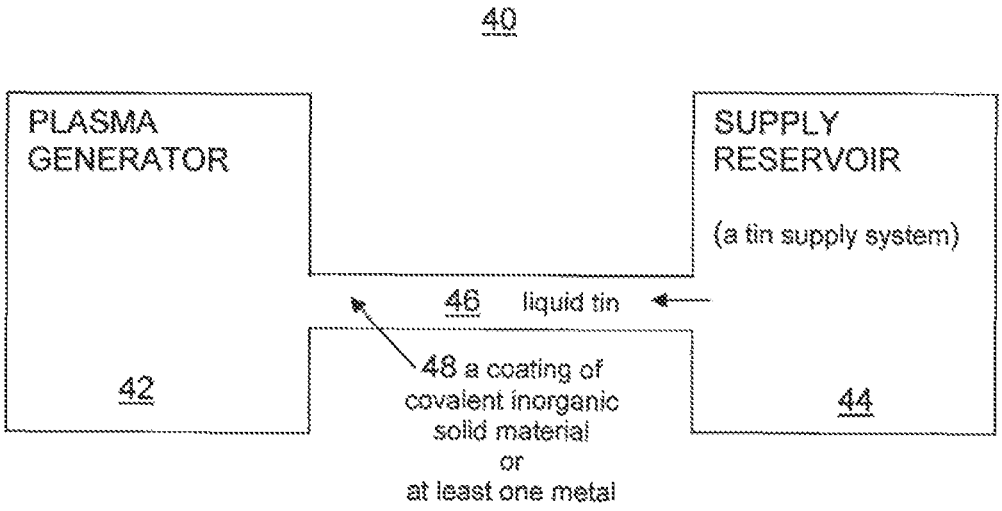
FIG. 4 is a diagram of a plasma generator in fluid communication with a supply reservoir of a tin supply system over a supply pipe that supplies liquid tin in accordance with embodiments of the present system.

The amount of corrosion of non-inventive compounds can e.g. be seen on FIG. 3, which shows the corrosion on non-treated Stainless steel.

The upper part ("@start") shows the sample just after immersion in the tin bath (approx. 30 minutes). Already there some stains and corrosive leaks can be seen, although to a minor degree.

However, already after 11 days of testing, clear corrosion can be observed, which is shown in the lower part of FIG. 3 ("@testing"). The inventive compounds, on the other hand, show no corrosion after 60 days (and some even after 90 days or more; usually then the test was stopped).

The particular combinations of elements and features in the above detailed embodiments are exemplary only; the interchanging and substitution of these teachings with other teachings in this and the patents/applications incorporated by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto. Furthermore, reference signs used in the description and claims do not limit the scope of the invention as claimed.

The invention claimed is:

1. A device for generating extreme ultra violet (EUV) radiation, the device comprising:

a plasma generator;

at least one tin supply system having a supply reservoir in fluid communication with said plasma generator; and at least one supply pipe configured to supply said plasma generator with liquid tin from said tin supply system, said supply pipe is at least partly coated with at least one covalent inorganic solid material.

2. The device of claim 1, wherein the at least one covalent inorganic solid material comprises a solid material selected from oxides, nitrides, borides, phosphides, carbides, sulfides, silicide, and mixtures thereof.

3. The device of claim 1, wherein the covalent inorganic solid material comprises at least one material with a melting point of ≧1000° C.

4. The device of claim 1, wherein the covalent inorganic solid material comprises at least one material with a density of ≧2 g/cm$^3$ and ≦8 g/cm$^3$.

5. The device according to claim 1, wherein the covalent inorganic solid material comprises at least one material selected from oxides, nitrides, borides, phosphides, carbides, sulfides, and silicides of Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, La, Ce, Pr, Nd, Sm, Eu, Gd, Tb, Dy, Ho, Er, Tm, Yb, Lu, Hf, Ta, W, Re, Os, Ir, Pt, Au, and mixtures thereof.

6. A device for generating extreme ultra violet (EUV) radiation, the device comprising:

a plasma generator;

at least one tin supply system having a supply reservoir in fluid communication with said plasma generator; and at least one supply pipe configured to supply said plasma generator with liquid tin from said tin supply system, said supply pipe is at least partly coated with at least one metal selected from the group consisting of IVb, Vb, VIb, and/or VIIIb metals or mixtures thereof.

7. The device according to claim 6, wherein the thickness of the metallic coating is ≧100 nm and ≦100 μm.

8. The device according to claim 6, wherein the roughness of the metallic coating is ≧1 nm and ≦1 μm.

* * * * *